United States Patent [19]

Becker et al.

[11] 4,009,036

[45] Feb. 22, 1977

[54] PHOTOGRAPHIC DEVELOPER

[75] Inventors: Manfred Becker, Leverkusen; Roswitha Ullrich, Burscheid, both of Germany

[73] Assignee: AGFA-Gevaert A.G., Leverkusen, Germany

[22] Filed: Dec. 9, 1974

[21] Appl. No.: 530,871

[30] Foreign Application Priority Data

Dec. 13, 1973 Germany ..... 2361947

[52] U.S. Cl. ..... 96/66.3

[51] Int. Cl.[2] ..... G03C 5/30

[58] Field of Search ..... 96/66, 66.3, 109

[56] References Cited

UNITED STATES PATENTS

| | | | |
|---|---|---|---|
| 2,586,168 | 2/1952 | Kaszuba | 96/109 |
| 2,948,615 | 8/1960 | Dersch et al. | 96/109 |
| 3,232,759 | 2/1966 | White et al. | 96/109 |
| 3,547,638 | 12/1970 | Cossar et al. | 96/109 |

OTHER PUBLICATIONS

Mason, Photographic Processing Chemistry 1966, pp. 20–22.

*Primary Examiner*—Mary F. Kelley
*Attorney, Agent, or Firm*—Connolly and Hutz

[57] ABSTRACT

A black and white developer solution containing o- or p-N-(2-hydroxyethyl)aminophenol as developer substance and a piperazine derivative of the formula

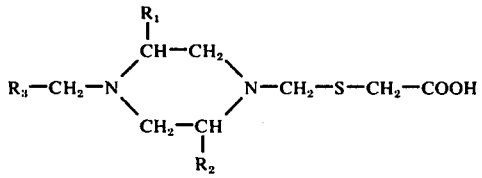

in which $R_1$, $R_2$ and $R_3$ denotes substituents as described hereinafter capable of developing a certain quantity of film e.g. 10 roll films per liter successively to substantially constant gamma values.

6 Claims, No Drawings

PHOTOGRAPHIC DEVELOPER

This invention relates to black and white developer solutions which are distinguished by their improved constancy of development speed with repeated use.

It is known that the composition of photographic developer solution changes constantly during development. Some of the components, such as the developer substance, sulphite ions and hydroxyl ions, are consumed while the concentrations of others, such as the bromide ions, increases. As a result of these changes the development speed drops. In order that a given quantity of imagewise exposed light-sensitive photographic material may always be developed to the same gamma value, it has hitherto been customary either to increase the development time from one film to the next, to regenerate the developer or to use it only once. All three methods have considerable disadvantages.

The simplest way of obtaining a constant gamma value is to use fresh developer solution for each development. If high yield developer solutions are used, the increased consumption of chemicals is a disadvantage of this method. This cannot always be obviated by using highly diluted developer solutions because only a low maximum gamma value can be obtained from them.

In the method of increasing the development time from film to film, it is difficult to obtain a constant gamma value. The amount by which the development time must be increased is generally not known sufficiently accurately since it depends not only on the number of films already developed but also on the exposure of the films.

Satisfactory results can be obtained by regenerating the developer but this method requires expensive apparatus and sensitometric procedures.

A further method has been disclosed in German Offenlegungsschrift No. 2,158,741. It comprises using an alkaline developer solution which contains iodide ions as development retarding additive and, e.g. N-(2-hydroxyethyl) -o-aminophenol, as developer substance. The iodide ions reduce the development speed by keeping the silver ion concentration low and they are consumed during development by converting silver bromide into silver iodide. Since the iodide ions are used up, their effect is gradually reduced and the development speed is thereby increased. At the same time, the reduction in concentration of developer substance and concentration of hydroxyl ions reduces the development speed. If the developer solution has a suitable composition, the influences to a large extent compensate each other and the developer activity remains virtually constant over a considerable time. A certain number of films (e.g. 10 roll films per liter) can be developed successively in such a developer to an almost constant gamma value without increasing the development time from film to film or regenerating the developer. It is therefore distinguished from conventional developers by the greater ease of handling. The presence of iodide ions, however, also has a disadvantage. It is known that sulphite has a certain capacity for dissolving silver halides and that used developers contain sulphito argentates in solution, from which silver is slowly deposited as a sludge. The deposition of silver is accelerated by the iodide ions, and this is found to be troublesome.

The problem therefore existed of finding a developer which would be capable of developing a certain quantity of film e.g. 10 roll films per liter, successively to substantially constant gamma values without the addition of iodide ions and without regeneration or increase in the development time.

It has now surprisingly been found that such developers can be obtained by using at least one o- or p-N-(2-hydroxyethyl)-aminophenol as developer substance and at least one piperazine derivative of the formula

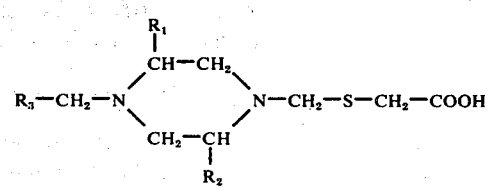

as the development-retarding additive, in which formula $R_1$ and $R_2$ may be the same or different and represent hydrogen or a short chain alkyl group, preferably a methyl group and $R_3$ = —H or —S—$CH_2$—COOH or a photographically inert group, e.g. a branched or straight chain alkyl group with preferably 1 to 5 carbon atoms such as a methyl, isopropyl or butyl group; a cycloalkyl group such as a cyclopentyl or cyclohexyl group; an aralkyl group such as a benzyl or phenethyl group; an aryl such as a phenyl or naphthyl group or a heterocyclic group such as a thienyl group; the aforesaid photographically inert groups may in turn be substituted, e.g. with a short chain alkyl, hydroxyl, aroxy, alkoxy, sulpho or carboxyl group.

This invention therefore relates to an aqueous alkaline photographic black-and-white developer solution which contains at least one o- or p-N-hydroxyethyl aminophenol developer substance which is used for developing exposed photographic materials comprising at least one silver halide emulsion layer in which the silver halide consists substantially of silver bromide, which developer solution is characterised by containing at least one piperazine derivative of the formula

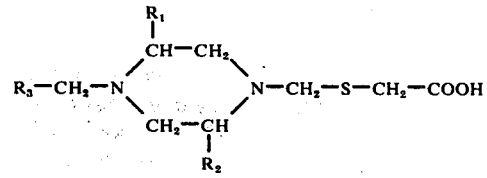

in which $R_1$ and $R_2$ may be the same or different and represent hydrogen or a short chain alkyl group, preferably a methyl group, and $R_3$ = —H or —S—$CH_2$—COOH or a photographically inert group which is stable in alkaline solution, e.g. a straight or branched chain alkyl group with preferably 1 to 5 carbon atoms such as a methyl, isopropyl or butyl group, a cycloalkyl group such as a cyclopentyl or cyclohexyl group; or aralkyl group such as a benzyl or phenylethyl group; an aryl group such as a phenyl or naphthyl group or a heterocyclic group such as a thienyl group. The aforesaid photographically inert groups may in turn be substituted, e.g. with a short chain alkyl, hydroxyl, aroxy, alkoxy, sulpho or carboxyl group.

The developer solution according to the invention has the surprising advantage of producing negatives with virtually constant gamma values even used for developing a large number of films.

If the gamma value obtained with a constant development time is represented graphically as a function of the number of roll films which have been developed in one liter of developer solution, the gamma/extent of utilisation graph is obtained. When this test is applied to developer solutions according to the invention, the graph is either substantially constant or passes through a flat maximum and then returns to the initial gamma value. Graphs obtained with conventional developer solutions, on the other hand, fall continuously and the gamma value moves progressively further away from the initial gamma value if no regeneration is carried out.

The developer solution according to the invention therefore need not be regenerated and is distinguished by the fact that it is simpler to handle than conventional developers.

According to a preferred embodiment, the developer solution according to the invention contains compounds of the above formula in which $R_1$ and $R_2$ represent hydrogen or methyl groups.

The following are examples of suitable compounds which may be used according to the invention:

1. 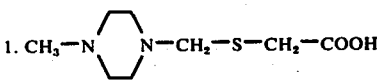

2. 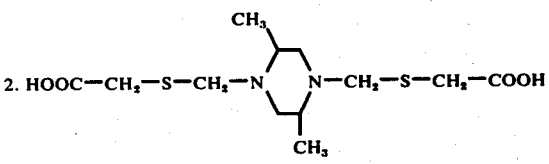

3. 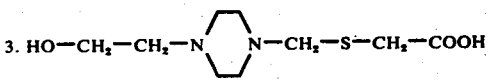

4. 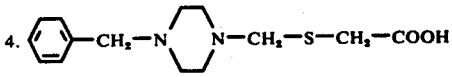

The concentration of the development retarding compound depends of the kind of the developer substances used and its concentration. The developer solutions used according to the invention preferably contain 0.3 to 30 mMol of the compound of the above formula per liter.

Suitable developer substances are e.g. N-(2-hydroxyethyl)-o-aminophenol, N-(2-hydroxyethyl)-p-aminophenol or N-[di-(2-hydroxyethyl)]-p-aminophenol used alone or in combination with each other. These compounds may contain further substituents on the benzene ring, such as short chain alkyl groups e.g. methyl, or halogen, e.g. chlorine. The developer solutions used according to the present invention contain the above developer substances in known concentration ranges depending on the desired effect. Generally concentrations of 8 to 12 g of developer substance per liter developer solution has been found to give good results. If wanted higher or lower concentrations can be used. Optimum results are generally obtained if the developer solutions contain about 10 g of developer-substance per liter and 0.3 to 30 mMol of the development retarding compound per liter.

Sodium sulphite or potassium sulphite is preferably used as antioxydant and the alkalis used are preferably borates or carbonates of sodium or potassium. The developer solutions according to the invention have the usual pH values, preferably 8.3 to 10.5.

The usual water softeners may also be added.

Small quantities of other developer substances which do not substantially alter the development speed may also be added to the developer solution according to the invention. These additional developer substances preferably have no, or only a very slight, superadditive effect with the developer substances according to the invention, for example N-butyl-N-(ω-sulphobutyl)-p-phenylene diamine or p-aminophenol.

Polyethylene oxides and polyethylene oxide derivatives which contain ammonium and phosphonium groups may be used as development accelerators.

Lastly, part of the water in the developer solutions according to the invention may be replaced by oligoethylene glycol monoalkyl ethers, e.g. diethylene glycol monoethyl ether, to lower the freezing point.

The developer solution according to the invention is particularly suitable for developing exposed photographic materials containing at least one silver halide layer in which preferably more than 80% of the silver content is in the form of silver bromide.

EXAMPLE 1

Photographic roll films containing a silver iodobromide gelatine emulsion layer (silver iodide content 6 mols-%) were exposed behind a grey step wedge in a conventional sensitometer. The exposed roll films were developed successively two by two in 1 liter of the following developer A (development temperature 20° C, development time 8 minutes in each case):

| Developer A (comparison developer) | |
|---|---|
| Water | 800 ml |
| N-(2-hydroxyethyl)-o-aminophenol-sulphate | 10 g |
| Sodium sulphite anhydrous | 100 g |
| Sodium metaborate-4-water | 20 g |
| Potassium bromide | 0.13 g |
| made up with water to 1 liter | |

Other roll films exposed in the same manner were developed successively two by two in 1 liter of the following developer B (development temperature 20° C, development time 10 minutes in each case): Developer B (developer according to the invention)

| Developer B (developer according to the invention) | |
|---|---|
| Water | 800 ml |
| N-(2-hydroxyethyl)-o-aminophenol-sulphate | 10 g |
| Sodium sulphite anhydrous | 100 g |
| Sodium metaborate-4-water | 20 g |
| Potassium bromide | 0.13 g |
| Compound 1 (4-methyl-1-(3-carboxy-2-thia-propyl)-piperazine) | 0.62 g |
| made up with water to 1 liter | |

The developed films were fixed, washed and dried in the usual manner. Sensitometric interpretation of the films produced the following results:

| Developer | Gamma in roll film No. 2 | 4 | 6 | 8 | 10 | 12 | 14 | Maximum deviation from initial gamma | average deviation from initial gamma |
|---|---|---|---|---|---|---|---|---|---|
| A | 0.68 | 0.68 | 0.67 | 0.60 | 0.60 | 0.56 | 0.55 | 19% | 10% |
| B | 0.68 | 0.69 | 0.67 | 0.68 | 0.67 | 0.69 | 0.70 | 3% | 1.5% |

In developer B according to the invention, the gamma value changed little and the maximum deviation from the initial gamma value was only 3%. In developer A which had a conventional composition and which differed from developer B only by the absence of 4-methyl-1-(3-carboxy-2-thia-propyl)-piperazine, the fall in gamma value for the same degree of utilisation was 19%. The compound 4-methyl-1-(3-carboxy-2-thia-propyl)-piperazine therefore had the effect of keeping the gamma value of the negatives practically constant when a large number of roll films was developed. It was prepared by the following method:

Working under protective nitrogen, 82.5 ml of a 40% formaldehyde solution which had been cooled to 0° C were added dropwise with stirring to 99 g of N-methyl piperazine which had been cooled to 0° C. The mixture heated up and was cooled down again to 0° C. After a reaction time of 15 minutes, a solution of 92 g of thigolycollic acid in 250 ml of ethanol was added under nitrogen with stirring. The mixture was kept at a temperature of 70° C for 20 minutes and then cooled to 0° C. The precipitate which separated was suction-filtered and recrystallised from four times the quantity of ethanol under nitrogen. The melting point was from 152° to 155° C with decomposition.

EXAMPLE 2

Photographic roll films containing a silver iodobromide gelatine emulsion layer (silver iodide content 6 mols-%) were exposed behind a grey step wedge in a sensitometer. The exposed roll films were developed successively two by two in one liter of the following developer C (development temperature 20° C, development time 13 minutes in each case):

| Developer C (developer according to the invention) | |
|---|---|
| Water | 800 ml |
| N-(2-hydroxyethyl)-o-aminophenol-sulphate | 10 g |
| Sodium sulphite anhydrous | 100 g |
| Sodium metaborate-4-water | 24 g |
| Potassium bromide | 0.13 g |
| Compound 2 (2,5-dimethyl-1,4-di-(3-carboxy-2-thia-propyl)-piperazine) | 0.25 g |

-continued

| Developer C (developer according to the invention) |
|---|
| made up with water to 1 liter |

The developed films were fixed, washed and dried in the usual manner. Sensitometric interpretation produced the following results:

| Developer | Gamma in roll film No. 2 | 4 | 6 | 8 | 10 | 12 | 14 | Maximum deviation from initial gamma | average deviation from initial gamma |
|---|---|---|---|---|---|---|---|---|---|
| C | 0.65 | 0.67 | 0.69 | 0.70 | 0.68 | 0.68 | 0.67 | 7.4% | 4.9% |

The maximum deviation from the initial gamma value in developer C was only 40% of the maximum deviation observed in comparison developer A.

2,5-dimethyl-1,4-di-(3-carboxy-2-thia-propyl)-piperazine was prepared by a similar method to that described in example 1 from 2,5-dimethyl-piperazine, formaldehyde and thioglycollic acid. The melting point was from 223° to 225° C with decomposition.

EXAMPLE 3

| Developer D (developer according to the invention) | |
|---|---|
| Water | 800 ml |
| N-(2-hydroxyethyl)-o-aminophenol-sulphate | 10 g |
| Sodium sulphite anhydrous | 100 g |
| Sodium metaborate-4-water | 20 g |
| Potassium bromide | 0.13 g |
| Compound 3 (4-(2-hydroxyethyl)-1-(3-carboxy-2-thia-propyl)-piperazine | 0.47 g |
| made up with water to 1 liter | |

Developer D was used in the same way as the developers in example 1 and 2 and the following results were obtained:

| Developer | Gamma in roll film No. 2 | 4 | 6 | 8 | 10 | 12 | 14 | maximum deviation from initial gamma | average deviation from initial gamma |
|---|---|---|---|---|---|---|---|---|---|
| D | 0.62 | 0.64 | 0.63 | 0.64 | 0.61 | 0.61 | 0.59 | 4.9% | 1.5% |

The compound 4-(2-hydroxyethyl)-1-(3-carboxy-2-thia-propyl)-piperazine was prepared by a similar method to that described in example 1 from N-(2-hydroxyethyl)-piperazine, formaldehyde and thioglycollic acid. The melting point was from 146° to 144° C decomposition.

EXAMPLE 4

| Developer E (developer according to the inventional) | |
|---|---|
| Water | 800 ml |
| N-(2-hydroxyethyl)-o-aminophenol-sulphate | 10 g |
| Sodium sulphite anhydrous | 100 g |
| Sodium metaborate-4-water | 20 g |
| potassium bromide | 0.13 g |
| compound 4 (4-benzyl-1-(3-carboxy 2-thia-propyl)-piperazine) | 0.55 g |
| made up with water to 1 liter | |

Developer E was used in the same way as the developers of examples 1 and 2 and the following results were obtained.

| Developer | Gamma in roll film No. 2 | 4 | 6 | 8 | 10 | 12 | 14 | maximum deviation from initial gamma | average deviation from initial gamma |
|---|---|---|---|---|---|---|---|---|---|
| E | 0.64 | 0.64 | 0.63 | 0.66 | 0.64 | 0.64 | 0.62 | 3.1% | 1.1% |

4-benzyl-1-(3-carboxy-2-thia-propyl)-piperazine was prepared by a similar method to that described in example 1 from N-benzyl-piperazine, formaldehyde and thioglycollic acid. The melting point was from 109° to 111° C with decomposition.

EXAMPLE 5

In this example, N-(2-hydroxyethyl)-p-aminophenol was used as the developer substance instead of the corresponding o-compound.

Photographic roll films containing a silver iodobromide gelatine emulsion layer (silver iodide content 6 mols-%) were exposed behind a grey step wedge in a sensitometer. The exposed roll films were developed successively two by two in 1 liter of the following developer F (development temperature 20° C, development time 5 minutes in each case):

| Developer F (comparison developer) | |
|---|---|
| Water | 800 ml |
| N-(2-hydroxyethyl)-p-aminophenol sulphate | 10 g |
| Sodium sulphite anhydrous | 100 g |
| Sodium metaborate-4-water | 20 g |
| Potassium bromide | 0.13 g |
| made up with water to 1 liter | |

Other roll films exposed in the same manner were developed successively two by two in 1 liter of the following developer G (development temperature 20° C. development time 9 minutes in each case):

| Developer G (developer according to the invention) | |
|---|---|
| Water | 800 ml |
| N-(2-hydroxyethyl)-p-aminophenol sulphate | 10 g |
| Sodium sulphite anhydrous | 100 g |
| Sodium metaborate-4-water | 20 g |
| potassium bromide | 0.13 g |
| compound 1 (4-methyl-1-(3-carboxy-2-thia-propyl)-piperazine | 0.62 g |
| made up with water to 1 liter | |

The developed films were fixed, washed and dried in the usual manner. Sensitometric interpretation of the films produced the following results:

| Developer | Gamma in roll film No. 2 | 4 | 6 | 8 | 10 | 12 | 14 | maximum deviation from initial gamma | average deviation from initial gamma |
|---|---|---|---|---|---|---|---|---|---|
| F | 0.73 | 0.71 | 0.64 | 0.64 | 0.63 | 0.60 | 0.60 | 18% | 7.6% |
| G | 0.70 | 0.70 | 0.71 | 0.71 | 0.73 | 0.70 | 0.69 | 4.3% | 1.0% |

The gamma value changed little in developer G according to the invention and the maximum deviation from the initial gamma was only about one quarter of the maximum deviation observed in comparison developer F.

4-methyl-1-(3-carboxy-2-thia-propyl)-piperazine therefore also kept the gamma value constant when added to N-(2-hydroxy-ethyl)-p-aminophenol which is a more rapid developer than the corresponding o-compound.

The developers according to the invention are distinguished from developers of conventional compositions not only by the reduction in the maximum deviation from the initial gamma value but also by the reduction in the mean deviation from the initial gamma value, as shown by the figures in the last column of the tables in examples 1–5.

We claim:

1. An aqueous alkaline photographic black- and white developer solution containing at least one o- or p-N-hydroxy-ethylaminophenol developer substance for developing exposed photographic materials which contain at least one silver halide emulsion layer in which the silver halide consists substantially of silver bromide, the improvement which comprises containing in said solution for development retardation at least one piperazine derivative of the formula

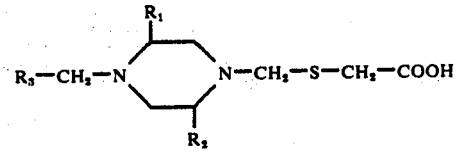

wherein $R_1$ and $R_2$ which may be the same or different represent hydrogen or methyl and $R_3$ represents hydrogen, —S—$CH_2$—COOH or a photographically inert group stable in alkaline solution selected from the class consisting of an alkyl, cycloalkyl, aralkyl, aryl or heterocyclic group in an amount of from 0.3 to 30 m Mol per liter.

2. Photographic developer solution according to claim 1, wherein $R_3$ represents hydrogen, —S—$CH_2$—COOH, alkyl of 1 to 5 carbon atoms, cyclopentyl, cyclophenethyl, phenyl, naphthyl or thienyl, which may be substituted with alkyl, hydroxyl, aroxy, alkoxy, sulfo or carboxyl groups.

3. Photographic developer solution according to claim 1 wherein $R_3$ represents hydrogen, hydroxymethyl, phenyl or —S—$CH_2$—COOH.

4. Photographic developer solution according to claim 1, wherein a compound selected from the group consisting of N-(2-hydroxyethyl)-o-aminophenol, N-(2-hydroxyethyl)-p-aminophenol and N-[di(2-hydroxyethyl]-p-aminophenol is contained as developer substance.

5. A process for development of imagewise exposed photographic materials which contain at least one silver halide emulsion layer by developing the exposed silver halide emulsion in a o- or p-N-hydroxyethylaminophenol developer and said process including developing wherein the improvement comprises developing the exposed silver halide emulsion in a developer containing for development retardation at least one piperazine derivative of the formula

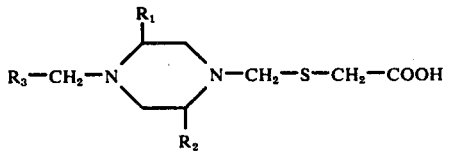

wherein $R_1$ and $R_2$ which may be the same or different represent hydrogen or methyl and $R_3$ represents hydrogen, —S—$CH_2$—COOH or a photographically inert group stable in alkaline solution selected from the class consisting of an alkyl, cycloalkyl, aralkyl, aryl or heterocyclic group in an amount of from 0.3 to 30 m Mol per liter.

6. A process according to claim 5, wherein $R_3$ represents hydrogen, —S—$CH_2$—COOH, alkyl of 1 to 5 carbon atoms, cyclopentyl cyclophenethyl, phenyl, naphthyl or thienyl, which may be substituted with alkyl, hydroxyl, aroxy, alkoxy, sulfo or carboxyl groups and $R_1$ and $R_2$ represents hydrogen or methyl.

* * * * *